United States Patent [19]

Blackmond

[11] 3,938,031

[45] Feb. 10, 1976

[54] ADJUSTABLE VOLTAGE POWER SUPPLY

[75] Inventor: Ronald C. Blackmond, Allison Park, Pa.

[73] Assignee: Robicon Corporation, Pittsburgh, Pa.

[22] Filed: Sept. 3, 1974

[21] Appl. No.: 502,656

[52] U.S. Cl. ..... 323/23; 307/71; 323/49

[51] Int. Cl.[2]..... G05F 1/40; G05F 1/66; G05F 3/08

[58] Field of Search ..... 307/37, 71; 315/191, 192; 318/83, 93, 95, 111, 409, 497; 320/16; 323/23, 24, 25, 43.5 S, 45, 49

[56] References Cited

UNITED STATES PATENTS

| | | | |
|---|---|---|---|
| 3,181,039 | 4/1965 | Binder et al. | 307/71 X |
| 3,195,038 | 7/1965 | Fry | 323/25 |
| 3,600,668 | 8/1971 | Goldberg | 323/45 X |
| 3,711,747 | 1/1973 | Sahara et al. | 323/49 X |
| 3,800,197 | 3/1974 | Mehta | 318/93 |
| 3,803,465 | 4/1974 | Akamatsu | 318/95 |

*Primary Examiner*—A. D. Pellinen

*Attorney, Agent, or Firm*—Brown, Murray, Flick & Peckham

[57] ABSTRACT

An adjustable voltage alternating current power supply is provided which is especially suitable for supplying loads of variable resistance. The power supply consists of a transformer having two secondary windings with solid-state switches for alternatively connecting the secondary windings in either parallel or series, and with a firing control circuit for changing the connection of the windings from parallel to series at a predetermined point in each half-cycle of the voltage to adjust the effective output voltage so that constant output power can be maintained, or the output power can be varied in any desired manner.

7 Claims, 8 Drawing Figures

ADJUSTABLE VOLTAGE POWER SUPPLY

BACKGROUND OF THE INVENTION

The present invention relates to alternating current power supplies, and more particularly to an adjustable voltage power supply suitable for supplying constant power to a variable resistance load.

Many industrial loads have resistances which vary with temperature or with time. For example, glass melting furnaces, where the glass is heated by electric current, have a negative temperature coefficient of resistance, and the resistance varies with the temperature in a manner that can cause uneven heating or thermal runaway so that effective control is necessary. Other types of loads, such as silicon carbide heater elements, for example, have a resistance which changes with time. In such cases, it is usually necessary or desirable to maintain constant power input to the load, or to control the power input in a predetermined manner. This can be done by suitably adjusting the voltage applied to the load so as to control the current to maintain the desired power input even though the resistance, or other characteristics of the load, may change with temperature or time or in any other manner.

One way in which this type of control may be achieved is to provide a transformer capable of supplying the maximum required voltage and maximum current, with phase angle switching control by means of solid-state switch devices in the secondary circuit to adjust the effective output voltage. This, however, requires a very expensive transformer and is not an economical solution to the problem if the range of variation of the load resistance is more than about 2 to 1. A better approach is to provide taps on either the primary winding or the secondary winding of the supply transformer with switching means to change the tap connections for the desired voltage range as required by the resistance of the load. Phase angle switching control can be used in connection with taps on either the primary winding or secondary winding to obtain a smooth control of the output voltage from zero to a maximum value. Solidstate tap selector switches in the secondary circuit have also been used and, with phase angle switching control, smooth control of the voltage can be achieved. These arrangements have been widely used but they are relatively expensive because of the provision of taps on the transformer winding which requires a special design, so that the cost is high as compared to standard transformers. Furthermore, such a design is somewhat difficult to accomplish at the higher current levels that may be required, with a further increase in cost.

SUMMARY OF THE INVENTION

The present invention provides an adjustable voltage alternating current power supply which permits smooth and continuous adjustment of voltage over a wide range without requiring taps on the transformer of special transformer designs.

In accordance with the invention a standard transformer may be utilized of the type having two secondary windings connectable either in series or in parallel for two different output voltages. Solid-state switching means are provided for use with such a transformer arranged to switch the secondary windings between the series and parallel connections. The switching means are controlled so that, in the higher voltage range, the connection of the secondary windings is changed from parallel to series at an adjustable predetermined point in each half-cycle of the output voltage. In this way the effective output voltage can be varied smoothly and continuously over a wide range, and the desired constant power input to a variable resistance load can be maintained with a relatively simple switching means and with a standard type of firing control for the solid-state switches. This results in a power supply in which the maximum power output is obtainable over a wide range of output voltages with a transformer of reasonable size and of standard construction and with relatively simple solid-state switching means.

BRIEF DESCRIPTION OF THE DRAWINGS

The invention will be more fully understood from the following detailed description, taken in connection with the accompanying drawings, in which.

DESCRIPTION OF THE PREFERRED EMBODIMENT

As previously discussed, the present invention provides an adjustable voltage alternating current power supply which is particularly suitable for maintaining constant input power to a variable resistance load.

Figure 1:
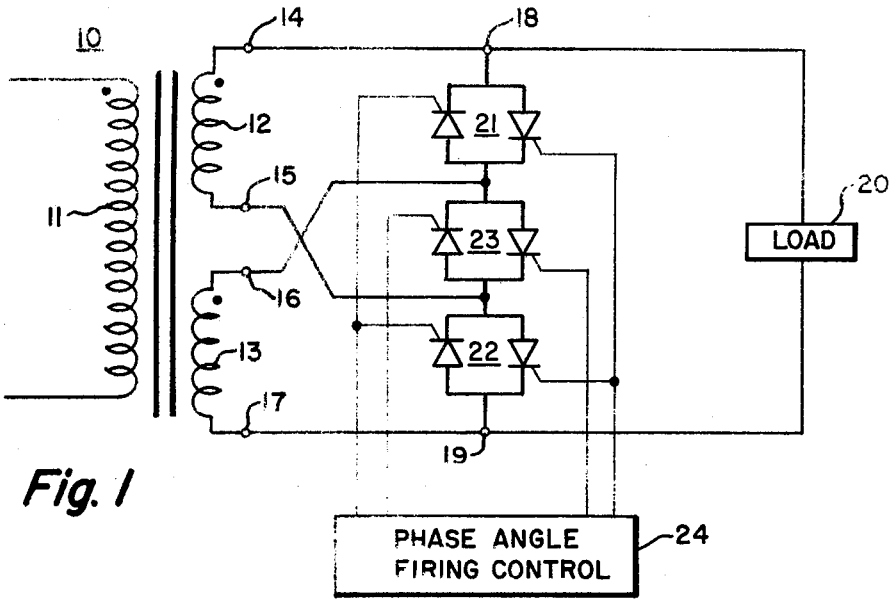
FIG. 1 is a circuit diagram illustrating a preferred embodiment of the invention.

In the preferred embodiment of the present invention shown in FIG. 1, a power transformer 10 is provided having a primary winding 11 adapted to be connected to a substantially constant line voltage. The transformer 10 has two secondary windings 12 and 13 wound on the same core and which are preferably substantially identical. That is, the windings 12 and 13 have the same number of turns so that their output voltages are the same to enable them to be connected in parallel, and the windings 12 and 13 have substantially the same maximum current rating so that they can be connected in series. The transformer 10 may be a two-secondary transformer of standard or conventional construction since no winding taps or other special features are required.

The windings 12 and 13 are connectable either in parallel or in series to provide two output voltages or two ranges of output voltage. Thus, for example, if each winding has a rating of 120 volts, the output voltage with the windings in parallel is 120 volts and with the two windings in series is 240 volts. Any desired voltages may, of course, be utilized. The relative polarities of the transformer windings are indicated in FIG. 1 by the usual convention of a dot at the ends of the windings which have the same instantaneous polarity. The winding 12 has output terminals 14 and 15 and the winding 13 has output terminals 16 and 17. The two windings are adapted to be connected either in series or in parallel to output terminals 18 and 19 for connection to a load 20 which, as previously indicated, may be a variable resistance load such as a glass furnace or an array of silicon carbide heaters where the resistance varies with temperature or time, or otherwise, and where a constant or controllable input power is desired.

The switching of the windings 12 and 13 between series and parallel connection is accomplished by solidstate switching means shown as three sets of semiconductor controlled rectifiers (SCR's), or thyristors, although any suitable type of switching devices could, of course, be used. Each set consists of two SCR's oppositely connected in parallel and adapted to be fired alternately for conduction on successive half-cycles. The first SCR set 21 is disposed to connect the terminal 16 of the winding 13 to the output terminal 18 to which the corresponding terminal 14 of the winding 12 is also connected. The second SCR set 22 is disposed to connect the terminal 15 of the winding 12 to the output terminal 19 and the corresponding terminal 17 of winding 13 is also connected to the output terminal 19. Thus, when the SCR's 21 and 22 are made conductive, the windings 12 and 13 are connected in parallel between the output terminals 18 and 19 to supply the lower of the available output voltages to the load 20. The third SCR set 23 is connected as shown between the opposite transformer winding terminals 15 and 16 so that when the SCR's 23 are made conductive, the windings 12 and 13 are connected in series between the terminals 18 and 19 to supply the higher output voltage to the load 20.

A firing control circuit 24 is provided for firing the SCR sets 21, 22 and 23 in the desired manner. The control circuit 24 may be any known or conventional type of phase angle firing control circuit adapted to fire the SCR's at predetermined or adjustable points in each half-cycle of the applied alternating current voltage, the SCR's of each pair being fired alternately in successive half-cycles in known manner for conduction on both half-cycles. As indicated in FIG. 1, the SCR sets 21 and 22 are fired simultaneously and the SCR's 23 are separately fired.

In accordance with the invention, as more fully discussed below, the SCR sets 21 and 22 are fired at each zero crossing of the voltage wave, and the SCR's 23 are then fired at a predetermined, adjustable point in each half-cycle. The circuit, as shown, is self-commutating. That is, firing of the SCR set 23 turns OFF the SCR sets 21 and 22. This may be seen from FIG. 1 in the following manner. Considering the secondary winding 13 during a positive half-cycle, with the appropriate SCR 21 conductive, the terminal 16 will be positive and current flows from terminal 16 through SCR 21 to terminal 18, and then through the load 20 and terminal 19 to negative winding terminal 17. Terminal 16 is thus positive with respect to output terminal 18. If SCR 23 is now fired to make it conductive and connect the windings 12 and 13 in series, the winding terminals 15 and 16 are connected together. The terminal 15 is negative, however, with respect to terminal 18 so that the polarity of the voltage across SCR 21 is reversed and the SCR is turned OFF. A similar effect occurs on the SCR set 22. The same effect with opposite polarities obviously occurs during the negative halfcycles. Turning the SCR set 23 ON, therefore, during either half-cycle, connects the windings 12 and 13 in series and simultaneously turns OFF the SCR sets 21 and 22 to interrupt the parallel connection. The circuit is, therefore, self-commutating and a standard phase angle type of firing control circuit can be utilized.

Figure 2:
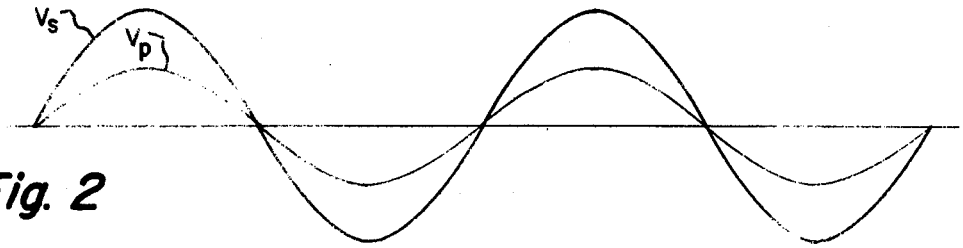
FIG. 2 shows typical output voltage waveforms.

The effect of this switching operation is illustrated in FIGS. 2 and 3A—3E. In FIG. 2, there is shown a voltage wave $V_p$ representing the output voltage across the terminals 18 and 19 when the windings 12 and 13 are in parallel, and a voltage wave $V_s$ representing the output voltage when the windings are in series. It will be seen that the voltage $V_s$ is twice the voltage $V_p$ so that two output voltages (120 volts and 240 volts, for example), or ranges of voltages (0–120 volts and 120–240 volts), are obtainable.

Figure 3A:
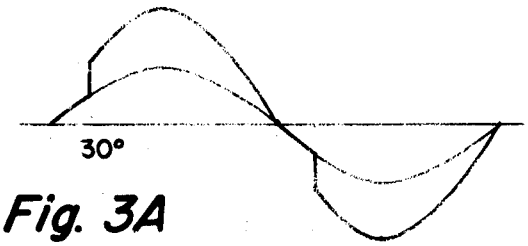
FIGS. 3A—3E show representative output voltage waveforms obtainable with the circuit of FIG. 1.
Figure 3B:
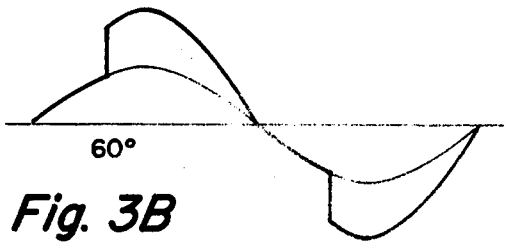
Figure 3C:
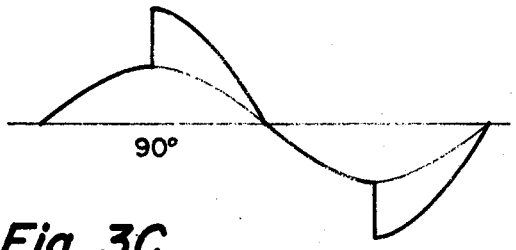
Figure 3D:
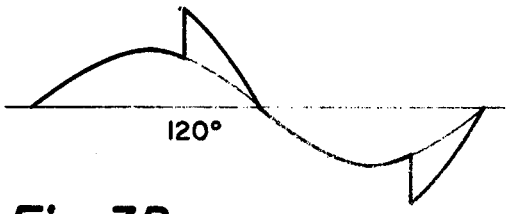
Figure 3E:
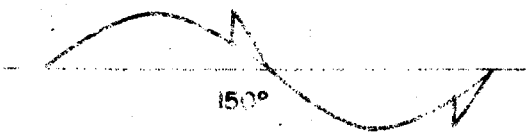

In accordance with the invention, the switching means described above are utilized to vary the output voltage over the range from $V_p$ to $V_s$, that is, from 120 volts to 240 volts in the illustrative example, and if desired, conventional phase angle control may be used with the windings in parallel to vary the voltage between zero and $V_p$. In accordance with the invention, the voltage is varied in the higher voltage range in the manner previously mentioned. That is, the SCR sets 21 and 22 are fired at each zero point of the transformer voltage to connect the windings 12 and 13 in parallel for the lower voltage $V_p$, and the SCR set 23 is fired at a predetermined point in each half-cycle to switch to the higher voltage $V_s$. The effect of this is illustrated in the curves of FIGS. 3A-3E which show typical output voltage waves obtained in this manner. Thus, FIG. 3A shows the effect of firing the SCR's 23 at an angle of 30° in each halfcycle to switch to the higher voltage. FIG. 3B shows switching at 60° in each half-cycle and FIGS. 3C, 3D and 3E show the voltage waves obtained by switching at 90°, 120° and 150°, respectively, the effective voltage progressively decreasing. It will be seen that switching from low to high voltage in this manner in each half-cycle makes it possible to obtain a range of effective output voltages which is smoothly and continuously adjustable from the voltage $V_p$ to the maximum voltage $V_s$. For example, if $V_p$ is 120 volts and $V_s$ is 240 volts, the following effective output voltages $V_o$ are obtained by switching from parallel to series at the points indicated.

| Switching Angle | Fig. | $V_o$ |
|---|---|---|
| 0° | 2 | 240 ($V_s$) |
| 30° | 3A | 237 |
| 60° | 3B | 221 |
| 90° | 3C | 190 |
| 120° | 3D | 151 |
| 150° | 3E | 125 |
| 180° | 2 | 120 ($V_p$) |

Intermediate voltages between those shown can obviously be obtained by control of the firing angle of the SCR set 23 so that a smooth, continuous control of output voltage is obtained over the entire voltage range.

Figure 4:
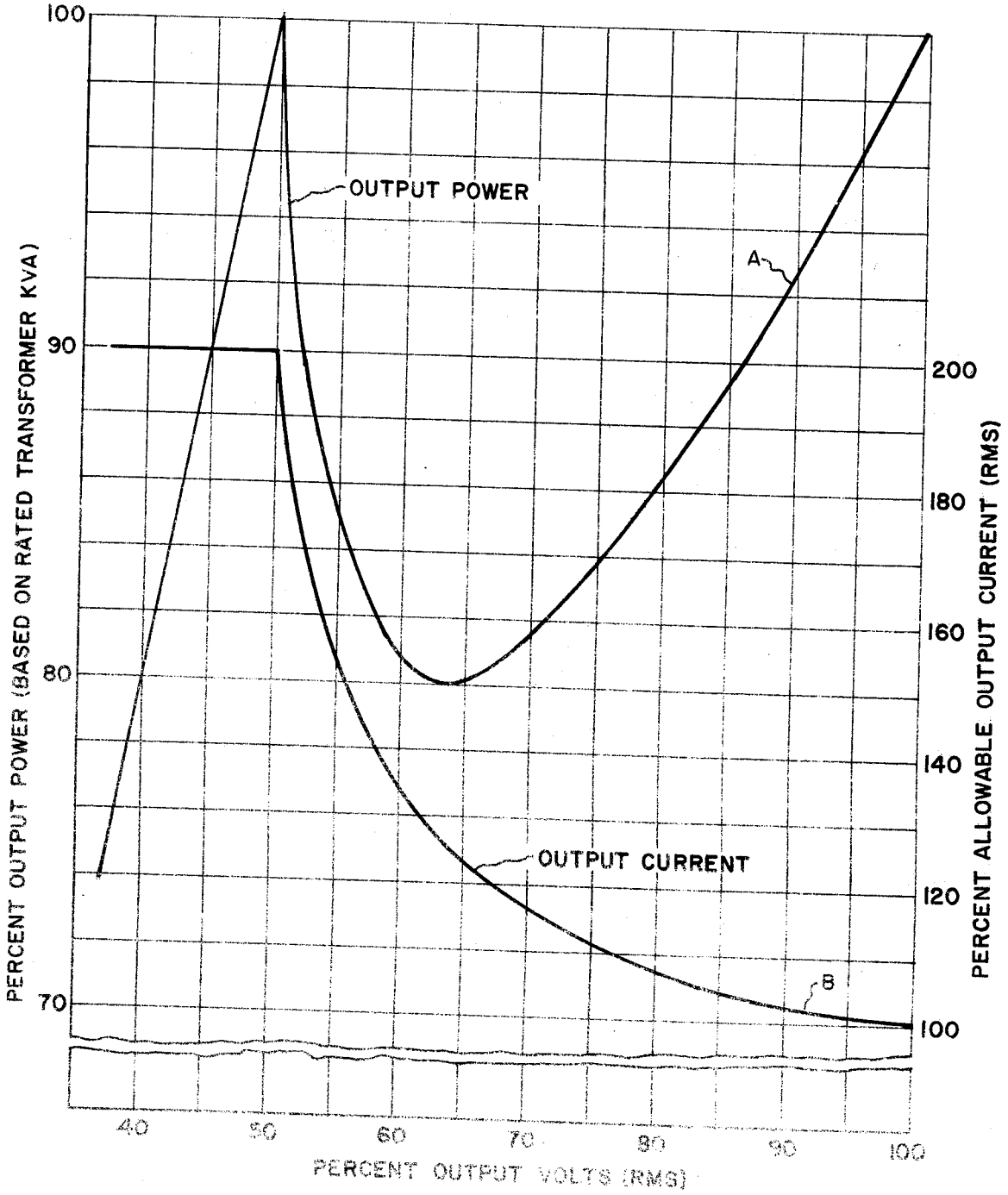
FIG. 4 is a set of curves showing the characteristics of the power supply of FIG. 1.

The effect of controlling the output voltage in the manner described is further illustrated by the curves of FIG. 4. Curve A of this figure shows the output power obtainable from the circuit of FIG. 1, and curve B shows the output current, both as functions of the output voltage for a given load resistance. The power is expressed as a percentage of the rated KVA output of the transformer 10 and the current is expressed as a percentage of the maximum allowable output current of a single secondary winding 12 or 13. The output voltage is also expressed in percentage, 100% being the maximum voltage $V_s$ with the two windings 12 and 13 in series, so that 50% voltage represents the voltage $V_p$ of a single winding or of the two windings in parallel.

It will be seen from an examination of the curves of FIG. 4 that the output power remains above 80% of the KVA rating of the transformer as the voltage is decreased and the effective current increases due to the increasing proportion of each half-cycle in which the windings remain in parallel. The output power thus remains above 80% of the transformer rating over a range starting at the rated current and maximum output voltage, with both windings in series, and extending until the current has increased to 200% and the voltage has decreased to 50%, representing both windings in parallel with maximum rated current in each winding, Beyond this point, the current cannot be further increased and as the voltage is further decreased, the output power correspondingly decreases and reaches 80% of the KVA rating at 40% output voltage, in the illustrated embodiment. Thus, the output power (kilowatts) remains above 80% of the KVA rating of the transformer throughout a range of output voltage from 40% to 100% (96 volts to 240 volts in the illustrative example), The power factor varying as indicated by the curve A (assuming a primarily resistive load). Constant power output up to the maximum transformer rating can, therefore, be maintained throughout this range, as the voltage can be adjusted as required by any change in the load resistance to vary the current to maintain the power output of the transformer constant. The output power can, of course, be varied in any desired manner by similar adjustment of the voltage.

It will now be apparent that an adjustable voltage power supply has been provided which has many advantages, and which makes it possible to maintain constant power input to a load having a resistance which varies with temperature or with time or otherwise. The power supply utilizes a transformer of standard construction which requires no taps or other special features, and utilizes simple solid-state switching means with a standard type of firing control. The switching arrangement illustrated, however, makes it possible to smoothly and continuously vary or adjust the output voltage as required to maintain constant output power, and maximum power can be maintained over a voltage range of the order of 2.5 to 1, as discussed above in connection with the curves of FIG. 4. This result is obtained with a transformer of relatively low cost, not only because of its standard construction but also because the maximum KVA rating of the transformer need be only 25% greater than the desired output power. This results because of the fact that during each half-cycle of operation, the transformer secondary windings operate in parallel at reduced current for a substantial part of each half-cycle and in series at full current for only a part of the half-cycle. The thermal duty on the transformer is accordingly reduced. This permits full advantage to be taken of the characteristic illustrated in FIG. 4 that maximum power output can be maintained over the desired voltage range without falling below 80% of the maximum KVA. The KVA rating of the transformer, therefore, need be only 25% greater than the maximum power desired. The firing control circuit 24 may be of any suitable type which can be adjusted to fire the SCR's at the desired phase angle in each half-cycle, and may be controlled manually to set the firing angle or may be controlled automatically in any desired manner in response to the load power or current, or in response to any desired characteristic of the load such as the temperature, or to any other desired quantity.

A preferred embodiment of the invention has been shown and described for the purpose of illustration but it will be understood that various modifications and other embodiments are possible. Thus, any desired type of solidstate switching means may be utilized which will operate in the manner described, and any desired type of firing control may be provided.

I claim as my invention:

1. An adjustable voltage alternating current power supply comprising two similar, substantially constant voltage sources, switching means for alternatively connecting said voltage sources in parallel or in series for connection to a load, and means for controlling said switching means to switch said voltage sources between parallel and series connections at predetermined points in each half-cycle of the applied voltage wave.

2. A power supply as defined in claim 1 in which said switching means comprises solid-state switching devices connected to effect series or parallel connection of said voltage sources.

3. An adjustable voltage alternating current power supply comprising transformer means having two substantially identical output windings, solid-state switching means for alternatively connecting said output windings in parallel or in series for connection to a load, and means for controlling said switching means to change the connection of the output windings from parallel to series at a predetermined point in each half-cycle.

4. A power supply as defined in claim 3 in which said switching means includes means for effecting parallel connection of said output windings, and means operative at a predetermined point in each half-cycle for connecting said windings in series and simultaneously interrupting the parallel connection.

5. A power supply as defined in claim 3 in which said switching means includes first solid-state switching means disposed to connect together corresponding terminals of said output windings to connect the windings in parallel to output terminals when the first switching means is conductive, and second switching means disposed to connect together opposite terminals of the output windings to connect the windings in series between the output terminals when the second switching means is conductive and the first switching means is nonconductive

6. A power supply as defined in claim 3 in which terminals of opposite instantaneous polarity of each of said windings are connected to respective output terminals, first solid-state switch means connecting the other terminal of each winding to the first-mentioned terminal of the other winding, whereby the windings are connected in parallel to the output terminals when the first switch means is conductive, and second switch means connecting together said other terminals of the windings when the second switch means is conductive and the first switch means is non-conductive.

7. A power supply as defined in claim 6 including control means for making said first switch means conductive at the beginning of each half-cycle to connect the windings in parallel and for making the second switch means conductive at an adjustable predetermined point in each half-cycle to connect the windings in series and to simultaneously make the first switch means non-conductive.

* * * * *